United States Patent [19]

Woilles et al.

[11] Patent Number: 4,859,071

[45] Date of Patent: Aug. 22, 1989

[54] HOMOGENIZING DEVICE FOR A FLUID CARRIED IN A PIPE

[75] Inventors: Jacques Woilles, Grenoble; Pierre Hayward, Saint Cloud, both of France

[73] Assignee: Societe Anonyme dite: Alsthom, Paris Cedex, France

[21] Appl. No.: 161,389

[22] Filed: Feb. 22, 1988

Related U.S. Application Data

[63] Continuation of Ser. No. 829,034, Feb. 13, 1986, abandoned.

[30] Foreign Application Priority Data

Feb. 14, 1985 [FR] France ..... 85 02104

[51] Int. Cl.[4] ..... B01F 5/04

[52] U.S. Cl. ..... 366/136; 366/173

[58] Field of Search ..... 266/136, 137, 143, 167, 266/173, 174, 176; 239/545, 430, 431, 421; 137/602, 896

[56] References Cited

U.S. PATENT DOCUMENTS

| | | | |
|---|---|---|---|
| 939,540 | 11/1909 | Palmer et al. | 366/173 X |
| 1,706,418 | 3/1929 | Sissom | 366/173 X |
| 2,582,802 | 1/1952 | Terrell, Jr. | 366/136 X |
| 2,751,425 | 6/1956 | Rupp | 366/173 X |
| 2,976,024 | 3/1961 | Martinek | 366/173 |
| 3,367,542 | 2/1968 | Madison | 222/630 |
| 3,391,908 | 7/1968 | MacDonald | 366/101 |
| 3,661,364 | 5/1972 | Lage | 366/136 |
| 3,666,663 | 5/1972 | Walker | 366/330 X |
| 4,045,004 | 8/1977 | Berger | 366/176 X |
| 4,365,988 | 12/1982 | Graham et al. | 366/137 X |
| 4,470,316 | 9/1984 | Jiskoot | 366/137 X |
| 4,494,413 | 1/1985 | Bukkems et al. | 366/137 X |

FOREIGN PATENT DOCUMENTS

| | | |
|---|---|---|
| 0060634 | 9/1982 | European Pat. Off. . |
| 2839064 | 3/1979 | Fed. Rep. of Germany . |
| 1052849 | 1/1954 | France . |
| 2117261 | 10/1983 | United Kingdom . |

*Primary Examiner*—Harvey C. Hornsby
*Assistant Examiner*—Scott J. Haughland
*Attorney, Agent, or Firm*—Sughrue, Mion, Zinn, Macpeak & Seas

[57] ABSTRACT

A fraction of a fluid mixture of two non miscible phases carried in a pipe (2) is tapped by a conduit (4), pressurized by a pump (6) and reinjected by nozzles (22, 24) to form jets which spray the drops of the discontinuous phase. For this purpose, these jets are installed like bars on a grid barring the pipe (2) with opposed jets of the discontinuous phase striking each other to ensure droplet formation.

11 Claims, 2 Drawing Sheets

HOMOGENIZING DEVICE FOR A FLUID CARRIED IN A PIPE

This is a continuation of application Ser. No. 829,034 filed Feb. 13, 1986, now abandoned.

FIELD OF THE INVENTION

This invention concerns a homogenizing device for a fluid carried in a pipe, the fluid having two non miscible phases one of which is discontinuous while the other is continuous. Such a device is designed, for example, to homogenize a mixture of petroleum and water flowing in a horizontal carrying pipe to enable a correct measurement of the water content in the mixture.

BACKGROUND OF THE INVENTION

This type of measurement is usually done by periodic and automatic sampling in the pipe, and so that the measurement performed on the samples represents the composition of the whole batch of fluid (cargo), it is first of all necessary that this batch be homogenous in compliance with ISO standard 3171. Well, the components of such a mixture tend to separate from each other naturally at least when its velocity is slow, for example, less than 1 m/s. So a homogenizing device must come into play a little distance upstream from the point where the samples are taken. Moreover, the size of the droplets of the discontinuous phase is important for the measurement. In the case of a petroleum conduit also carrying a little water, it is necessary that the mixture arriving at the measurement device be of petroleum containing several water droplets per $cm^3$ of mixture, with a droplet diameter of from 0.5 mm to 2 mm at the most.

Homogenizing may also be useful in the following cases:

when a pipe is carrying a multiphase fluid whose phases have the tendency to separate from each other (because of gravity, for example) and when this separation has a harmful effect upon operations and/or causes abnormal wear or corrosion of the conduits upstream from the connecting point a secondary pipe supplying a user of the fluid carried, in order that this user will receive a product whose two phases are in the proper proportions when it is desired, on-line, to mix two liquid components in order to produce a product.

Various devices for homogenizing a fluid carried in a pipe are already known, for example in British Patent No. 2.303.963 (JISKOOT Autocontrol Ltd.) and European Patent No. 0060634 (Moore, Barrett and Redwood Ltd.).

The device in European Patent No. 0060634 includes the following elements which are shared, in terms of certain of their functions, by this known device and by the device according to the invention:

a tapping conduit (4) having a tapping opening in this carrier pipe (2) to suck off a fraction of the flow of the fluid to be homogenized, this opening being placed a zone which is enriched by gravity in the discontinuous phase, this zone being the top or bottom zone of this pipe according to whether the discontinuous phase is more dense or less dense than the continuous phase, respectively, a circulating pump (6) installed at the output from the tapping conduit to circulate and pressurize the fluid which has been sucked off, an injection conduit (8, 10, 12, 14, 16, 18) receiving the fluid pressurized in this way, and injection nozzles (20, 22, 24, 26) fed by this injection conduit and forming, in this pipe, cross jets which create swirls to homogenize the said fluid carried, and each of these nozzles has an axis which is also the axis of the jet which it forms.

(The reference numbers or letters between parentheses refer to the examples shown on the appended figures)

This known device is particularly applicable for carrying petroleum mixed with water. If is the water which constitutes the so-called discontinuous phase. A certain homogenization can be obtained with the aid of this device, but on the one hand, the power of the circulating pump must be high because of the necessity of injecting a flow which represents a relatively large fraction of the total flow so that the stirring induced will be sufficient, and on the other hand, this device precludes dissociating the phase to be dispersed in droplets of well known and sufficiently tiny dimensions, which do not necessarily prevent a later very rapid decantation or coalescence of the drops of the discontinuous phase nor, consequently, the danger of distorting the measurement by sampling.

This is perhaps because this device was designed for homogenizing by stirring the mixture.

The purpose of the present invention is to build a simple device to make it possible to obtain a good homogenization with the following properties:

on the one hand, the size of the drops in the discontinuous phase is reduced, on the other hand, the small drops formed in this way are well dispersed and their number per $cm^3$ of mixture is relatively uniform, and this is done without the power needed at the circulating pump being substantially greater than the power necessary for the operation of the known devices, and without the present device having a cumbersome longitudinal bulk.

SUMMARY OF THE INVENTION

The device according to the invention includes the abovementioned shared components. It is characterized by the fact that at least some of the abovementioned injection nozzles are spray nozzles (20, 22, 24) which are arranged in a spray surface cutting across this carrier pipe, and which form spray jets oriented in this surface in order that the axis of each of these jets constitutes, over at least part of its length, a bar of a grid, occupying this surface and barring this pipe, so that each spurt of the said discontinuous phase, arriving at this surface, is forced to pass at a distance from one of these bars which are small and less than one-quarter of the diameter of this pipe, each so-called bar, formed by one of these nozzles, being limited, beginning with this nozzle, to a length which is substantially less than the diameter of this pipe, in order to preserve in the said spray jet, over the whole lenght of this bar, sufficient velocity to provide the spray of such a spurt passing at the said small distance. Preferably, the opening diameter of the said spray nozzle (20, 22, 24) is from 0.5 to 6% of the diameter of this pipe if it is circular, or equal to its equivalent hydraulic diameter, the initial velocity of these jets being from 5 to 60 meters per second, in order enable each of these jets to efficiently spray the spurts of the said discontinuous phase over the said length of the bar made up by this jet, the number of these jets and their distribution in the said spray surface being such that each point of this surface is found at a distance from at least one of these bars which is less than approximately 15 times the diameter of the nozzle which forms this bar, the length of this bar being less than 20 times the diameter of this nozzle.

More particularly and preferably, in the case of water dispersed in petroleum, the opening diameter of the said spray nozzle is from 1% to 3% of the opening diameter of the said carrier pipe, the initial velocity of the said spray jets being from 10 to 30 meters per second, their number being from approximately 10 to 50.

Furthermore, the following arrangements can be advantageously adopted:

one or more other of the said injection nozzles are premixing nozzles (26), less numerous than the spray nozzles (20, 22, 24) and arranged upstream from them and downstream from the said tapping opening (4*a*) in the said discontinuous phase enriched zone, to form premix jets aimed toward the inside of the carrier pipes (2), in order to place into suspension a fraction of any of the discontinuous phase which has not been sucked off in this tapping opening, the number of the said premix nozzles (26) is from approximately 10% to 20% of the number of the injection nozzles (20, 22, 24), these injection nozzles being arranged at a distance downstream from the said spray nozzles of from approximately 100% to 50% of the diameter of the carrier pipe (2), at least some of the said spray jets are directed toward each other to be stopped against each in order that the force remaining in these jets will break up the drops of the discontinuous phase which they contain, the said nozzles (20, 22, 24) and the spray jets form pairs of nozzles and corresponding pairs of jets, the two jets of each pair being opposite each other, the distance between the two nozzles (20, 22) of the corresponding pair being approximately 10 to 20 times the opening diameter of these nozzles, the said spray nozzles (20, 22, 24) are carried and fed by at least one tubular injection ring (10, 12) which is part of the said injection conduit (8, 10, 12, 14, 16, 18) and arranged coaxially in the said carrier pipe (2).

The number of such injection rings will often be 1, 2 or 3 according to the diameter of the carrier pipe. Their general shape is advantageously circular is this pipe has a circular section, but other forms are possible.

Particularly, in the case where the pipe carries a mixture of petroleum and water, the following additional arrangements seem advantageous:

two of the said injection rings are offset according to the length of the carrier pipe (2) and are an outside ring (10) whose diameter is close to the diameter of this pipe, and an inside ring (12) whose diameter is less than half of the diameter of the pipe, certain of the said pairs of nozzles being outside pairs, each formed by an outside nozzle (20) carried by the outside ring, and an inside nozzle (22) carried by the inside ring, certain other of these pairs being inside pairs each made up of two nozzles (24), carried by the inside ring, the said spray surface then including a plane surface limited by the inside ring, and a truncated annular surface extending between these two rings, in order to set up, at the fluid carried, a passage section, which is sufficient in spite of the obstructing of the carrier pipe by these two rings, the axes of the nozzles (20, 22) of the said outside pairs are arranged along the generatrices of a coaxial cone at the carrier pipe and passing via the two said rings (10, 12), and the axes of the nozzles (24) of the said inside pairs, are parallel to a shared direction, perpendicular to the length of this pipe (2), in order to set up the said grid with a limited number of spray jets and nozzles.

In a more general manner, still other arrangements appear generally advantageous:

the said spray nozzles (20, 22) are more numerous in the said enriched zone, in order that the maximum distance from one point of the said spray surface to the closest spray jet will be reduced within this zone and the energy dissipated by these jets per unit of volume will be greater there, the said injection conduit (8, 10, 12, 14, 16, 18) carries the said injection nozzles (20, 22, 24, 26) and constitutes, within the carrier pipe (2), a mechanically strong unit, within the interval between two planes which are perpendicular to this pipe and whose distance is at least equal to the diameter of this pipe, this unit including a cover (26) to plug a manhole (28) in the wall of this pipe, and being fastened to the edges of this hole, so that it will easy to extract this unit from the pipe for its maintenance and to reinstall it afterward in operating position.

These choices are made based upon the following considerations:

To dissociate a phase into droplets of known dimensions, it is necessary to dissipate an energy E per unit of volume of product, and the diameter D of the droplets is a direction function of E. Well, a jet which comes out in a liquid medium dissipates, per unit of volume carried by this jet, a power which has the function of velocity V of the jet, and of its diameter D. The power of the circulating pump and the characteristics of the conduits and nozzles must therefore be chosen in order to obtain, for the jet, values of V and D such that the drops formed with the discontinuous phase will have the desired diameter or a smaller diameter.

Furthermore, the energy dissipated per unit of volume and consequently, the efficiency of the dissociation, are increased if jets are used which are converging or which are stopped suddenly by a fixed obstacle.

It is important that the dissipation of energy near the spray jets really affects the two phases; if the jet only has one phase, at the moment of the reinjection into the conduit, a part of its energy might be dissipated into a phase without having any effect upon the dissociation to droplets.

An internal mixing by sucking off in the enriched zone is therefore useful before bringing out the jet, and the same is true for a dispersion before the discontinuous phase.

With the aid of the appended figures with their diagrams, we are going to describe below, in a way which is not the only way, how the invention can be implemented. When a single element is represented on several figures, it is designated there by the same reference symbol.

DESCRIPTION OF THE PREFERRED EMBODIMENT

Figure 1:
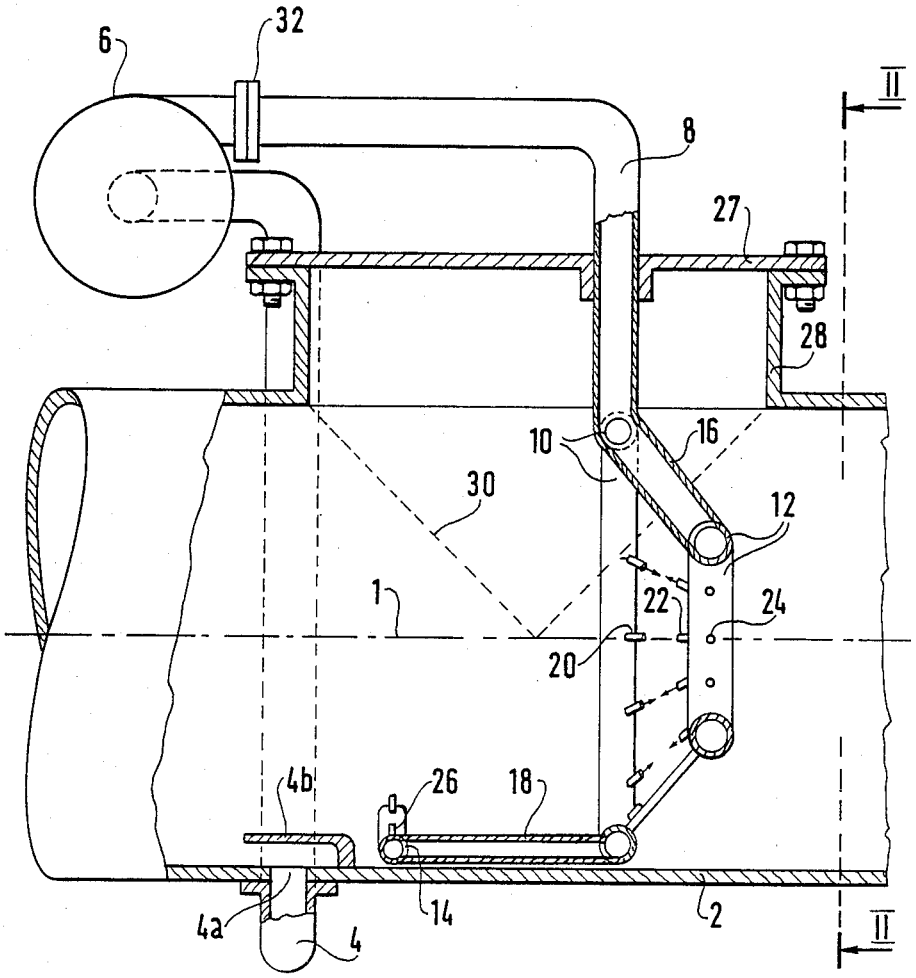
FIG. 1 represents a view of a device according to the invention in cross section with a plane pasing through the axis of the carrier pipe.
Figure 2:
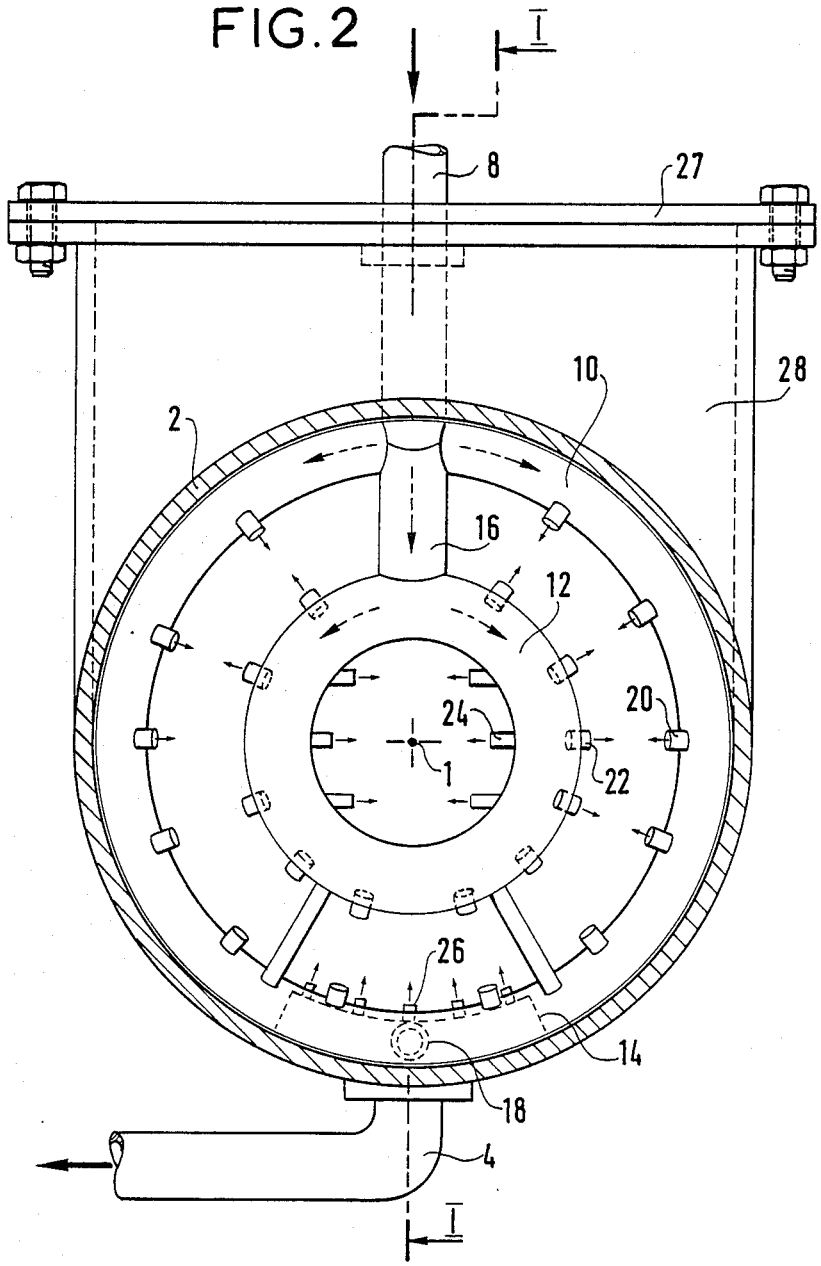
FIG. 2 represents a view of the same device in cross section with a plane II—II represented on FIG. 1, perpendicular to the axis of the carrier pipe.

The homogenizing device described according to the invention applies to a mixture carried of petroleum and water. It includes the elements mentioned earlier according to the invention:

The tapping conduit 4 sucks off a fraction of the fluid flow to be homogenized in carrier pipe 2 which is cylindrical and has a horizontal axis 1. The circulating pump 6 is driven by a motor, which is not shown, to pressurize the fluid which has been sucked off in this way. The injection conduit brings the fluid which has been pressurized in this way into the carrier pipe. It includes a length 8 at the output from pump 6, the two circular injection rings 10 and 12 arranged in the carrier pipe 2, coaxially to it, an injection array 14 upstream from these rings, and connecting pipes 16 and 18 feeding the inside ring 12 and the array 14 from the outside ring 10. The latter is directly fed by section 8. Its diameter is the greatest possible for fitting easily into conduit 2. Inside ring 12 is arranged somewhat downstream from the outside ring and has approximately half its diameter. These two rings carry the said spray nozzles 20, 22, 24 as mentioned above. Array 14 forms a coaxial circle arc at the bottom of pipe 2 and carries the said premix nozzles 26.

Opening 4*a* of the tapping conduit 4 is at the bottom of pipe 2 upstream from the rings and injection arrays 10, 12 and 14 and it is fitted with an inlet guide 4*b*.

In the case of a pipe 2 with a diameter of 76 cm, carrying petroleum of average viscosity, close to 0.1 poise, mixed with a low proportion of water, varying for example around 10%, each nozzle may have, for example, a diameter of 9 mm, and be supplied at a sufficiently high pressure, above the pressure in the transfer pipe, to supply a velocity at the outlet from the nozzle of 15 to 20 meters per second.

The number of nozzles 20 of the outside ring is 12, the same number as for the nozzles 22 of the inside ring, opposite the preceding ones, to form the said outside pairs. In addition, the inside ring has three inside pairs of nozzles 24 opposite each other, aimed in the same direction as the jets which are horizontal and perpendicular to pipe 2.

The outside ring is formed by incurving a tube, diameter 60 mm. The inside ring has an outside diameter of 40 cm and consists of a tube of diameter 80 mm.

There are five premix nozzles.

To make it possible to easily remove and reinstall the unit formed by the injection conduit with these rings and arrays as indicated above, this conduit is fastened to a cover 27 which plugs a manhole 28 in the form of a cylindrical tube with vertical axis cutting axis 1 of the carrier pipe, and with the same diameter. Like the pipe, the tube is made of sheet steel, with a weld along the intersecting line 30 of the tube. Conduit 8 is connected at the outlet from the pump 6 by a removable coupling 32.

We claim:

1. In a homogenzing device for a liquid forming an axial flow stream in a carrier pipe said liquid comprising two non miscible phases, one of which is continuous and the other of which is discontinuous and forms spurts in said continuous phase, said device comprising:

a tapping opening (4*a*) in said carrier pipe, means including a (a) tapping conduit (4) coupled to said tapping opening (4*a*) in said carrier pipe (2) and comprising a circulating pump (6) to suck off and pressurize a fraction of the flow of said liquid to be homogenized, whereby some of said spurts of said discontinuous phase can be sucked off by said tapping means and some others can constitute remaining spurts in the remaining fraction of said liquid, an injection nozzles (20, 22, 24, 26) for receiving said sucked off and pressurized fraction and forming respective strong cross jets which create swirls in said carrier pipe to homogenize said liquid to be homogenized, whereby said cross jets loose their strength progressively from the said respective injection nozzles, the improvement comprising:

at least some of said injection nozzles being spray nozzles disposed in said carrier pipe such that limited lengths of said respective cross jets from said spray nozzles constitute respective spray jets in a jet grid like pattern which extends over a whole cross section of said carrier pipe and which does not leave any place in said cross section for any one of said remaining spurts to pass at a distance greater than a limited distance from at least one of said spray jets, said limited lengths being substantially less than the diameter of said carrier pipe and said limited distance being less than one-quarter of the diameter of said carrier pipe, such that said any one remaining spurt is then broken into droplets due to the strength and the proximity of said one spray jet.

2. Device according to claim 1, wherein the opening diameter of said spray nozzles (20, 22, 24) if from 0.5% to 6% of the diameter of said pipe, or its equivalent hydraulic diameter, said circulating pump giving to said spray jets an initial speed from 5 to 60 meters per second, inorder to enable each of said jets to efficiently spray said spurts of said discontinuous phase over said limited length of said spray jet, said limited length being less than 20 times the diameter of said spray nozzles, said jet grid like pattern being completely shaped by said limited lengths of said spray jets, and said limited distance being less than approximately 15 times the diameter of said spray nozzles.

3. Device according to claim 2, wherein said discontinuous phase is water, and said continuous phase is oil, and wherein the opening diameter of the said spray nozzles (20, 22, 24) is from 1% to 3% of the diameter of the said carrier pipe (2), wherein the initial velocity of the said spray jets is from 10 to 30 meters per second, and wherein their number is approximately from 10 to 50.

4. Device according to claim 1, wherein said injection nozzles also include premix nozzles (26) installed upstream from said spray nozzles (20, 22, 24) and downstream from said tapping opening (4*a*) in an enriched zone in the discontinuous phase, to form premix jets aimed toward the inside of the carrier pipe (2), for placing in suspension a fraction of the discontinuous phase which was not sucked off into said tapping opening.

5. Device according to claim 4, wherein the number of the said premix nozzles (26) is from 10% to 20%, approximately, of the number of the spray nozzles (20, 22, 24), and said spray nozzles are installed at a distance downstream from the said premix nozzles equal to 100% to 50%, approximately, of the diameter of the carrier pipe (2).

6. Device according to claim 1, wherein at least some of the said spray jets face each other and impinge against each other such that the force of the impinging jets breaks up the discontinuous phase into droplets.

7. Device according to claim 6, wherein said spray nozzles 20, 22, 24) define pairs of nozzles and corresponding pairs of jets with two jets of each pair being opposite each other, and the distance between the two nozzles (20, 22) of the corresponding pair being from 10 times to 20 times, approximately, the opening diameter of these nozzles.

8. Device according to claim 7, including an injection conduit connecting the circulating pump and the injection nozzles and wherein said injection conduit includes at least one tubular injection ring (10, 12) having at least some of said spray nozzles (20, 22, 24) thereon, said at least one tubular injection ring being installed coaxially in said carrier pipe (2).

9. Device according to claim 8, wherein said at least one tubular injection ring comprises two tubular injection rings which are axially offset within said pipe (2) and which consist of one outside tubular injection ring (10) whose diameter is close to the diameter of said pipe, and one inside tubular injection ring (12) whose diameter is less than half of the diameter of said pipe, said pairs of nozzles including outside pairs each made up of one outside nozzle (20) carried by the outside tubular injection ring, and one inside nozzle (22) carried by the inside tubular injection ring, and said pairs further including inside pairs each made up of two nozzles (24) carried by the inside tubular injection ring, oriented perpendicular to the axis of the pipe (2), said jet grid like pattern including a first section limited by the tubular injection inside ring, and a truncated annular section extending between said two axially offset tubular injection rings, in order to provide a flow stream with a passage section which is sufficiently large in spite of the obstruction of the two tubular injection rings carried by said pipe to adequately pass the flow of the two non miscible phases.

10. Device according to claim 9, wherein the axes of the spray nozzles (20, 22) of the said outside pairs are oblique to the planes of the two tubular injection rings respectively and arranged along the generatrices of a cone which is coaxial with the carrier pipe and defined by said two tubular injection rings (10, 12), and the axes of the nozzles (24) of each of the said inside pairs are parallel to each other and in a plane perpendicular to the axis of said pipe (2), in order to set up the said grid like pattern with a limited number of nozzles and spray jets.

11. Device according to claim 1, wherein said pipe has an enriched zone and said spray nozzles (20, 22) are more numerous in said enriched zone, in order that the maximum distance from a point in said spray jet grid like pattern to the nearest spray jet will be reduced in this zone such that the energy dissipated by these jets per unit of volume will be greater in said zone.

* * * * *